United States Patent [19]

Pasquarello

[11] 4,014,054

[45] Mar. 29, 1977

[54] SHAMPOO DEVICE

[76] Inventor: Edward J. Pasquarello, 5 Silvermine Road, Woburn, Mass. 01801

[22] Filed: May 7, 1976

[21] Appl. No.: 684,159

[52] U.S. Cl. ..... 4/159

[51] Int. Cl.[2] ..... A47K 3/12; A61H 35/00

[58] Field of Search ..... 4/159–166, 4/167, 168

[56] References Cited

UNITED STATES PATENTS

| | | | |
|---|---|---|---|
| 772,763 | 10/1904 | Walters | 4/159 |
| 792,498 | 6/1905 | Carr | 4/159 X |
| 835,814 | 11/1906 | Dalton | 4/159 |
| 1,617,537 | 2/1927 | Morin | 4/159 |
| 2,818,585 | 1/1958 | Campbell | 4/159 X |
| 2,850,742 | 9/1958 | Glintz | 4/159 |
| 3,192,537 | 7/1965 | Coffman et al. | 4/159 |

*Primary Examiner*—Henry K. Artis

[57] ABSTRACT

A shampoo aid that comprises a cape adapted to fit over the shoulder area, a neck covering portion adapted to receive the chin, a rearwardly disposed slide to receive the water and carry it away from the head and a shampoo hose and hose fitting to communicate with a water faucet.

9 Claims, 3 Drawing Figures

30
32
28
42
26
38
36
40
20
22
10
18
44
16
12
34

3
12
24
14
16
26
44
30
32
22
18
40
36
12
3

12
36
12
10
42
44

SHAMPOO DEVICE

BACKGROUND OF THE INVENTION

This invention relates to a shampoo device; more particularly to a cape that carries a water hose and is adapted to be hooked up to a source of water, such that the water run off from the hair as well as splash water are carried away from the person and into a suitable reservoir therefor disposed behind the same.

The prior art teaches a variety of shampoo aids, such as disclosed in U.S. Pat. Nos. 2,357,461; 2,600,557; 2,600,392; 2,637,853; 2,684,072; 3,040,336; 3,854,148; and others. While these aids can be employed in washing the hair, they fail to provide effective means for guarding against water flow down the neck as well as hose means communicating therewith to facilitate washing of the hair.

SUMMARY OF THE INVENTION

It is accordingly an object of the instant invention to avoid one or more drawbacks of the prior art.

It is another object of the invention to provide for an improved aid in washing the hair and scalp.

It is a further object to provide for the same at relatively little cost thereby making the same generally available.

These and other objects and advantages of the invention will become more apparent from the following detailed disclosure and claims and by reference to the accompanying drawings, in which:

Figure 1:
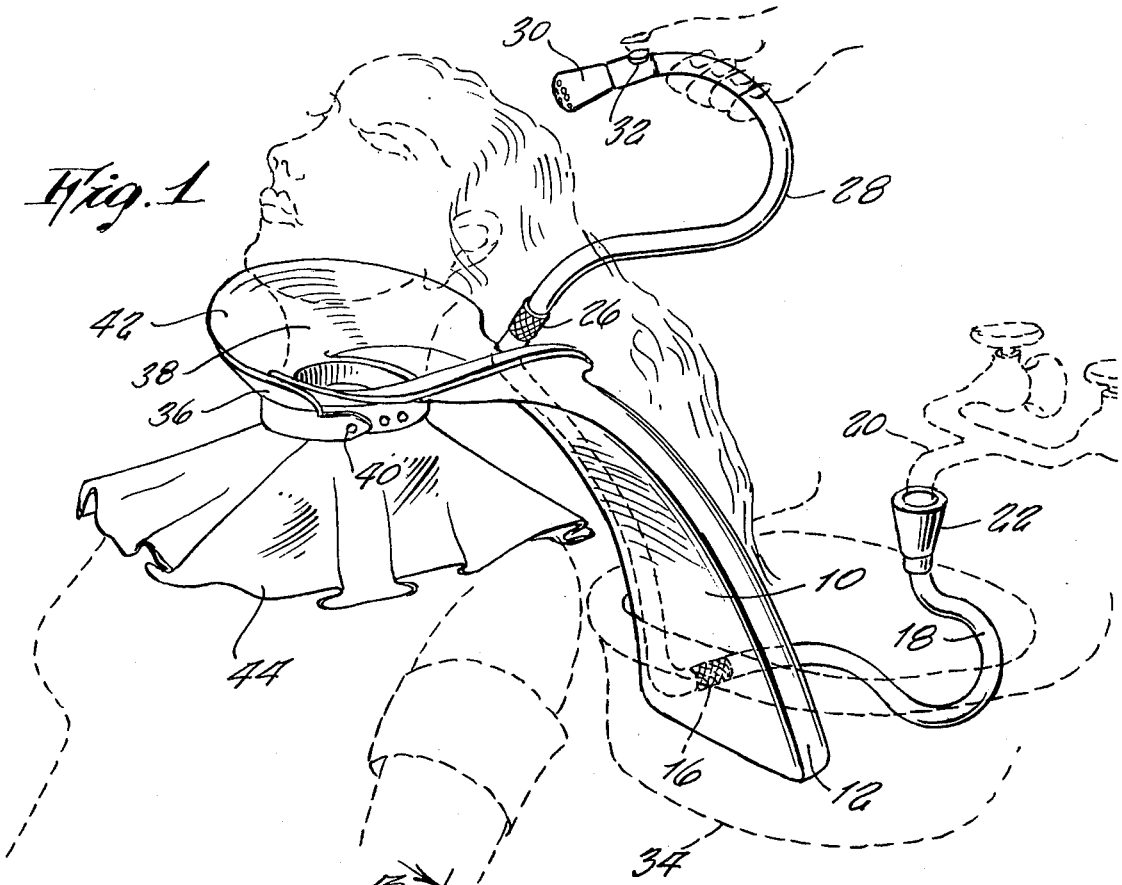
FIG. 1 is a perspective view.
Figure 2:
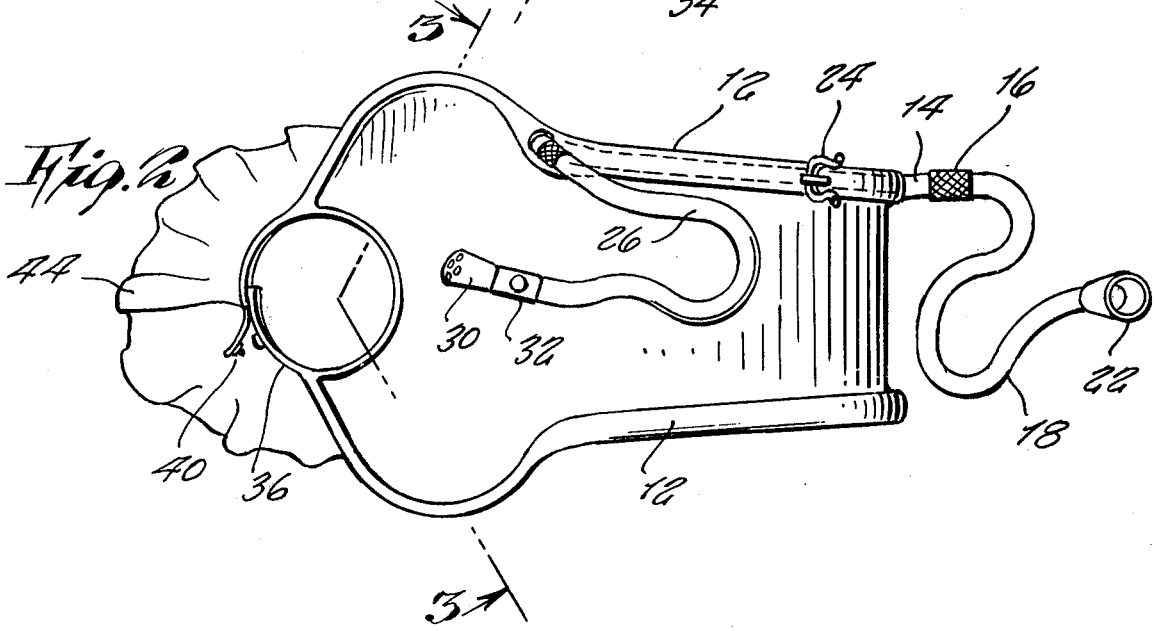
FIG. 2 is a top plan view.
Figure 3:
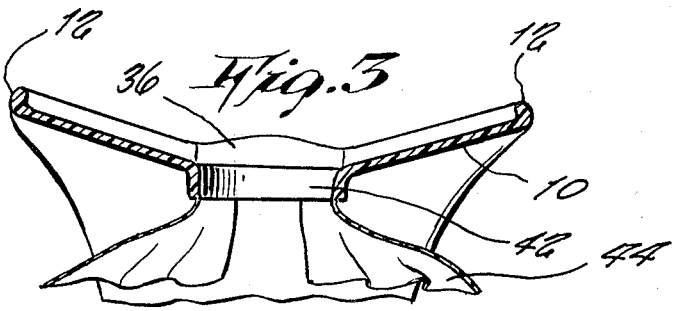
FIG. 3 is a front elevational view.

Broadly speaking, the instant invention includes the provision of a shampoo device, comprising a tray shaped liquid receiving surface for conveying liquid away from the head, a pair of opposing laterally disposed ridges on the tray for preventing water overflow, at least one of the ridges defining an internally disposed channel open at both ends and adapted to convey a flow of water, first and second hose engaging part means disposed on each open end of the channel, a first length of hose communicating with the first part and a supply of water, a second length of hose communicating with the second part and adapted to supply water to the head, an arcuate shaped collar adapted to engage the neck, closure means adapted to securely engage the collar about the neck and a flexible apron of water impermeable material depending from the collar and adapted to engage the shoulders.

DETAILED DISCLOSURE

Referring more particularly to the drawing, there is shown a rearwardly inclined, preferably substantially rigid tray or apron 10 that includes a pair of opposing laterally disposed channels 18 that form a lip or flange around the lateral edges to prevent water from moving off the same. At least one channel 12 defines an opening that may house a suitable length of hose 14 to carry water. The lower end of the channel 12 will have a part or mouth 14 that is adapted to receive and engage by suitable means 16 another length of hose 18 that is adapted to connect to a source of water such as at a water faucet 20, by suitable means 22 such as an enlarged opening or the like. A clip means 24 or the like to engage the hose 18 may be provided on the exterior surface of the channel 12. The opposite end of the channel 12 will also accommodate the receipt by suitable means 26 (or exit) of an (interiorly disposed) hose 28 that preferably has a shower head 30 or the like thereon. If desired, water control means 32 (i.e., hand valve) such as to arrest and begin the flow of water therefrom. As will be seen, the apron 10 is adapted to engage a sink 34 or the like to collect the water. The top portion of the apron 10 will define a U shaped upwardly inclined collar portion 36 that is adapted to receive and engage the neck 38 therein, and provide for a chin rest 42 suitable closure means 40 such as a tie string or the like are provided to facilitate closing the collar 36 about the neck 38. A flexible sheet member 44 of water impermeable material, i.e., plastic, rubber communicates with the collar portion 36 and is disposed therebeneath and is adapted to drape over the shoulders in order to protect the same.

Since it is obvious that numerous changes and modifications can be made in the above-described details without departing from the spirit and nature of the invention, it is to be understood that all such changes and modifications are included within the scope of the invention.

I claim:

1. A shampoo device, comprising a tray shaped liquid receiving surface for conveying liquid away from the head, a pair of opposing laterally disposed ridges on said tray for preventing water overflow, at least one of said ridges defining an internally disposed channel open at both ends and adapted to convey a flow of water, first and second hose engaging part means disposed on each open end of said channel, a first length of hose communicating with said first part and a supply of water, a second length of hose communicating with said second part and adapted to supply water to the head, an arcuate shaped collar adapted to engage the neck, closure means adapted to securely engage said collar about the neck and a flexible apron of water impermeable material depending from said collar and adapted to engage the shoulders.

2. A device as defined in claim 1 wherein said collar has an upwardly inclined arcuate shape.

3. The device as defined in claim 1 wherein said tray is arcuate shaped.

4. The device as defined in claim 1 wherein said channel includes a hose.

5. The device as defined in claim 1 wherein there are a pair of channels.

6. The device as defined in claim 1 additionally including means disposed on said parts for engaging said hoses.

7. The device as defined in claim 1 wherein said second hose includes hand activated valve means and a water dispersing head.

8. The device as defined in claim 1 wherein at least one of said ridges includes clip means for engaging said first hose.

9. The device as defined in claim 1 wherein said tray depends downwardly from said collar position and is integral therewith.

* * * * *